US011144002B2

(12) United States Patent
Shiokawa et al.

(10) Patent No.: US 11,144,002 B2
(45) Date of Patent: Oct. 12, 2021

(54) IMAGE FORMING APPARATUS AND CONVEYANCE CONTROL METHOD

(71) Applicant: KONICA MINOLTA, INC., Tokyo (JP)

(72) Inventors: Yasuo Shiokawa, Tokyo (JP); Yoshiteru Kawakami, Tokyo (JP); Takahiro Okubo, Kanagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 491 days.

(21) Appl. No.: 15/986,890

(22) Filed: May 23, 2018

(65) Prior Publication Data

US 2018/0341212 A1 Nov. 29, 2018

(30) Foreign Application Priority Data

May 24, 2017 (JP) ..... JP2017-102431
May 24, 2017 (JP) ..... JP2017-102433

(51) Int. Cl.
*B65H 7/10* (2006.01)
*B65H 9/10* (2006.01)
(Continued)

(52) U.S. Cl.
CPC ..... *G03G 15/6564* (2013.01); *B65H 5/062* (2013.01); *B65H 9/002* (2013.01);
(Continued)

(58) Field of Classification Search
None
See application file for complete search history.

(56) References Cited

U.S. PATENT DOCUMENTS 9,857,750 B1 1/2018 Moriya et al.
10,577,206 B2 * 3/2020 Okubo ..... G03G 15/6564
(Continued)

FOREIGN PATENT DOCUMENTS

JP 2002-308469 A 10/2002
JP 2006-240265 A 9/2006
(Continued)

OTHER PUBLICATIONS

Office Action (Communication pursuant to Article 94(3) EPC) dated Oct. 9, 2019, by the European Patent Office in corresponding European Patent Application No. 18173071.4. (7 pages).
(Continued)

*Primary Examiner* — Jill E Culler
*Assistant Examiner* — Ruben C Parco, Jr.
(74) *Attorney, Agent, or Firm* — Buchanan Ingersoll & Rooney PC

(57) ABSTRACT

The image forming apparatus includes a transfer section that transfers an image to a sheet; a sheet conveying member that is provided on an upstream side of the transfer section in a conveying direction of the sheet and that conveys the sheet; and a hardware processor that controls displacement of the sheet conveying member such that the sheet is displaced in a width direction of the sheet. The hardware processor causes a detector that detects an edge of the sheet in the width direction to detect the edge of the sheet after displacement of the sheet conveying member has been started, and causes the displacement to be terminated on the basis of the detected result such that the edge of the sheet reaches a target position.

19 Claims, 9 Drawing Sheets

(51) Int. Cl.

| | |
|---|---|
| ***G03G 15/00*** | (2006.01) |
| ***B65H 5/06*** | (2006.01) |
| ***B65H 9/00*** | (2006.01) |
| ***B65H 9/20*** | (2006.01) |

(52) U.S. Cl.
CPC ..... *B65H 9/20* (2013.01); *G03G 15/6567* (2013.01); *G03G 15/6561* (2013.01); *G03G 2215/00561* (2013.01)

(56) References Cited

U.S. PATENT DOCUMENTS

| | | | | |
|---|---|---|---|---|
| 2011/0064499 | A1* | 3/2011 | Johnston | B65H 9/006 399/388 |
| 2011/0089623 | A1* | 4/2011 | Kato | B65H 7/10 270/58.07 |
| 2014/0139573 | A1* | 5/2014 | Sasa | B41J 15/042 347/5 |
| 2014/0193186 | A1 | 7/2014 | Furuyama | |
| 2016/0109840 | A1 | 4/2016 | Oonishi | |
| 2019/0315586 | A1* | 10/2019 | Yamane | B65H 7/14 |

FOREIGN PATENT DOCUMENTS

| | | | |
|---|---|---|---|
| JP | 2013-238752 | A | 11/2013 |
| JP | 2014-133634 | A | 7/2014 |
| JP | 2016-079003 | A | 5/2016 |
| JP | 6103121 | B1 | 3/2017 |

OTHER PUBLICATIONS

Extended European Search Report dated Sep. 18, 2018, issued by the European Patent Office in corresponding European Application No. 18173071.4. (8 pages).

First Office Action dated Aug. 5, 2020, by the State Intellectual Property Office of the People's Republic of China in corresponding Chinese Patent Application No. 21810507187.2 and an English translation. (14 pages).

Office Action (Notice of Reasons for Refusal) dated Mar. 9, 2021, by the Japanese Patent Office in corresponding Japanese Patent Application No. 2017-102431 and English translation of the Office Action. (8 pages).

Office Action (Notice of Reasons for Refusal) dated Mar. 9, 2021, by the Japanese Patent Office in corresponding Japanese Patent Application No. 2017-102433 and English translation of the Office Action. (8 pages).

Notice of Reasons for Refusal dated May 18, 2021, by the Japanese Patent Office in corresponding Japanese Patent Application No. 2017-102433 and an English machine translation of the Notice. (11 pages).

* cited by examiner

-- Prior Art --

IMAGE FORMING APPARATUS AND CONVEYANCE CONTROL METHOD

CROSS REFERENCE TO RELATED APPLICATIONS

The entire disclosure of Japanese Patent Application No. 2017-102431 and No. 2017-102433, each filed on Mar. 24, 2017, are incorporated herein by reference in their entirety.

BACKGROUND

Technological Field

The present invention relates to an image forming apparatus and a conveyance control method.

Description of Related Art

Image forming apparatuses utilizing electrophotographic process technology (printers, copiers, facsimile machines, for example) typically form electrostatic latent images by irradiating (exposing) charged photoconductor drums (image bearing members) with (to) laser beams on the basis of image data. Toner images are then formed by supplying toner from a developing section to the photoconductor drums, on which the electrostatic latent images have been formed, so as to visualize the electrostatic latent images. Further, the image forming apparatus transfers the toner images (primary or secondary transfer), and then fixes the toner images on sheets through heating and pressing of the sheets by a fixing nip of a fixing section. In such an image forming apparatus, registration rollers for correcting positional shifts in the width direction of sheets are provided on the upstream side of a transfer section that transfers images to the sheets (see, for example, Japanese Patent Application Laid-Open No. 2014-133634 (hereinafter, referred to as Patent Literature (PTL) 1)).

Meanwhile, an image forming apparatus has a problem in which a phenomenon that a conveying direction of a sheet bends toward the sub-scanning direction (sub-scanning obliqueness) occurs due to misalignment among registration rollers, a secondary transfer nip, and a fixing nip. In addition to the misalignment, such sub-scanning obliqueness also tends to occur when diameters in both ends of a roller in the width direction of a sheet (sub-scanning direction) differ due to wear, for example. Further, long sheets, whose size is long in the conveying direction, are susceptible to such effects and thus sub-scanning obliqueness occurs noticeably. Since such sub-scanning obliqueness causes image defects due to shifting and/or distortion, for example, of images to be transferred in a transfer section, there is a need for a technique that reduces sub-scanning obliqueness.

In view of the above, PTL 1 describes a technique of registration displacement control in which a line sensor is arranged between registration rollers and transfer rollers, a position of a sheet edge in the width direction (side edge) is detected during conveyance of the sheet by the transfer rollers, and the registration rollers are moved on the basis of the detected results.

The technique described in PTL 1 detects a shift of a sheet side edge from a reference position by a line sensor, determines an amount of displacement for registration rollers on the basis of the detected result, and performs control so as to displace the registration rollers by the determined amount.

Accordingly, in some cases, the sheet side edge is shifted from the reference position when such displacement is terminated.

SUMMARY

An object of the present invention is to provide an image forming apparatus and a conveyance control method that enable further proper correction of sub-scanning obliqueness of sheets.

To achieve at least one of the abovementioned objects, an image forming apparatus reflecting one aspect of the present invention includes:

a transfer section that transfers an image to a sheet;

a sheet conveying member that is provided on an upstream side of the transfer section in a conveying direction of the sheet and that conveys the sheet; and a hardware processor that controls displacement of the sheet conveying member such that the sheet is displaced in a width direction of the sheet, in which:

the hardware processor causes a detector that detects an edge of the sheet in the width direction to detect the edge of the sheet after displacement of the sheet conveying member has been started, and causes the displacement to be terminated on the basis of the detected result such that the edge of the sheet reaches a target position.

A conveyance control method reflecting another aspect of the present invention is a conveyance control method for an image forming apparatus including a transfer section that transfers an image to a sheet and a sheet conveying member that is provided on an upstream side of the transfer section in a conveying direction of the sheet and that conveys the sheet, where the sheet conveying member is displaced such that the sheet is displaced in a width direction of the sheet, and the method includes:

starting displacement of the sheet conveying member;

detecting an edge of the sheet in the width direction after the displacement has been started; and terminating, on the basis of the detected result, the displacement of the sheet conveying member such that the edge of the sheet reaches a target position.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3A illustrates a state before a registration roller pair is moved and FIG. 3B illustrates a state after the registration roller pair has been moved;

FIG. 4A illustrates a state before a registration roller pair is moved and FIG. 4B illustrates a state after the registration roller pair has been moved;

FIG. 5A shows a procedure of registration displacement to which the conventional control technique is applied, and FIG. 5B shows a procedure of registration displacement of the embodiment;

FIG. 6A shows a case of the registration displacement by the conventional control technique and FIG. 6B shows a case of the registration displacement of the embodiment;

FIG. 8A shows an example case in which displacement is started at regular timings over the full length of a sheet, and FIG. 8B shows an example case in which displacement is started at irregular timings.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
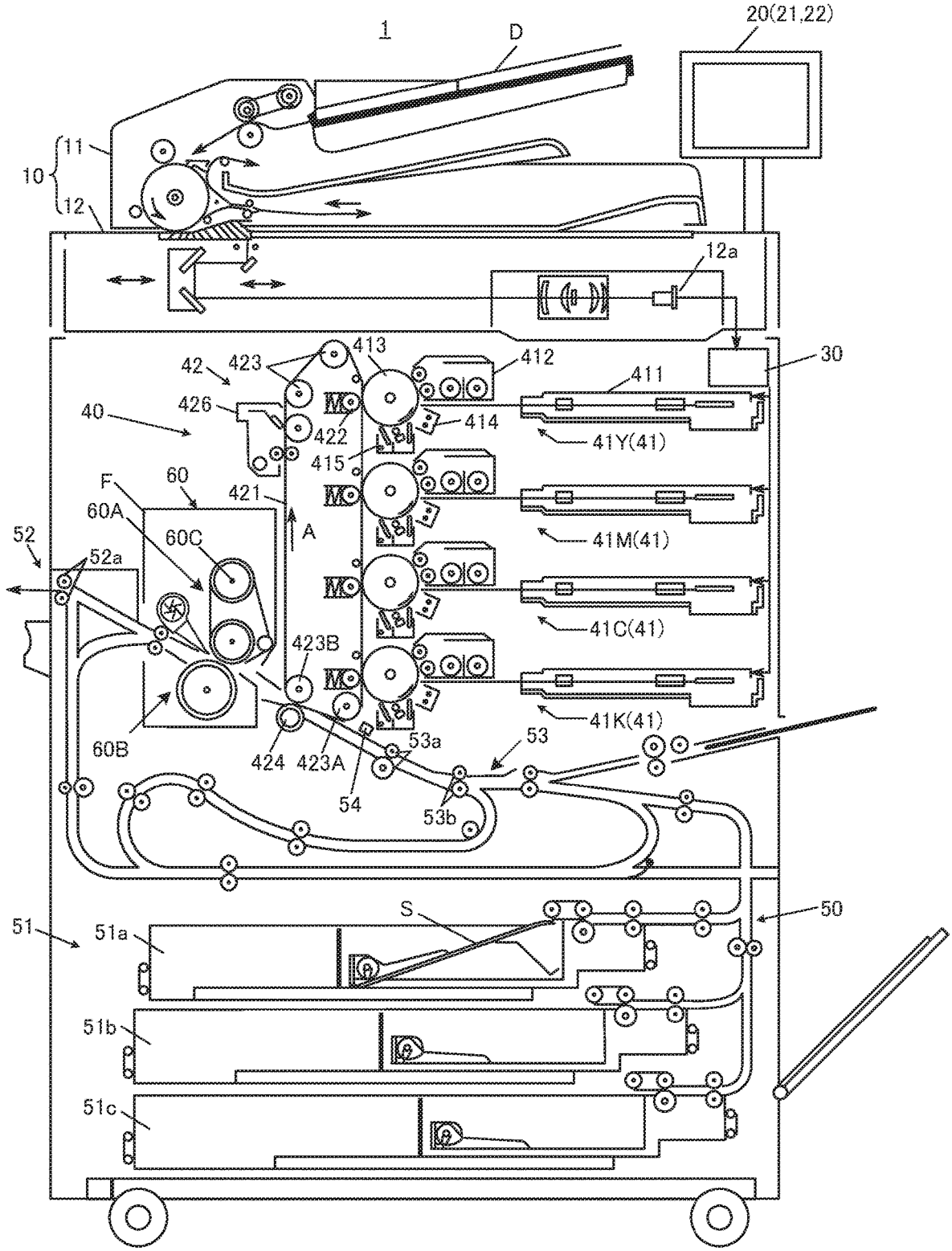
FIG. 1 schematically illustrates the entire configuration of an image forming apparatus of an embodiment.
Figure 2:
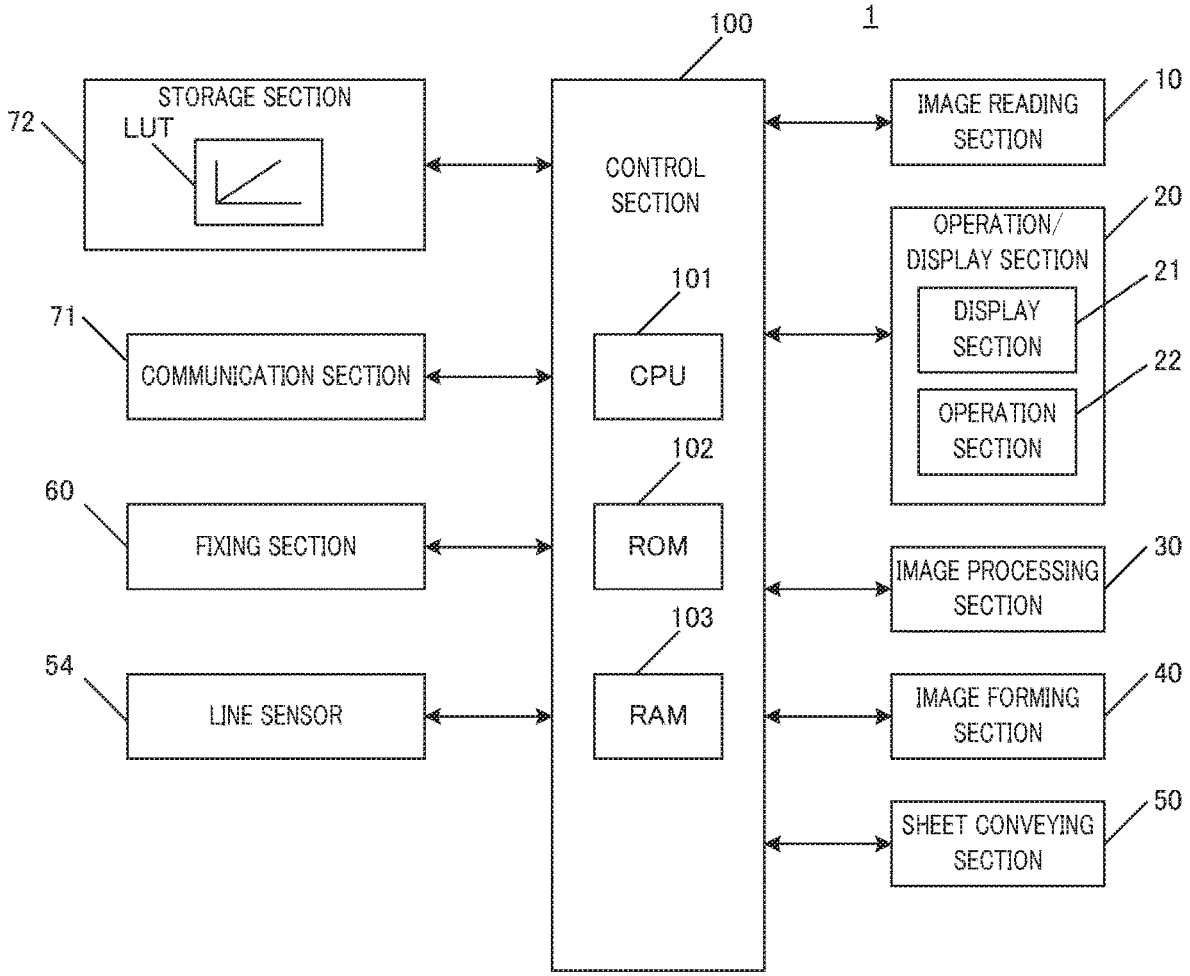
FIG. 2 is a block diagram showing the main part of a control system of the image forming apparatus of FIG. 1.

Hereinafter, the embodiment will be described in detail with reference to the drawings. FIG. 1 schematically illustrates the entire configuration of image forming apparatus 1 of the embodiment. FIG. 2 illustrates the main part of a control system of image forming apparatus 1 of the embodiment.

Image forming apparatus 1 of the embodiment uses long paper or non-long paper as sheets S and forms images on sheets S.

In the embodiment, long paper refers to sheets longer in the conveying direction than commonly and frequently used sheets, such as A4-size or A3-size sheets, for example. Hereinafter, those simply referred to as "sheets" may include both long paper and non-long paper.

Image forming apparatus 1 is an intermediate transfer-mode color image forming apparatus utilizing electrophotographic process technology. In other words, image forming apparatus 1 forms toner images by transferring color toner images of yellow (Y), magenta (M), cyan (C), and black (K) formed on photoconductor drums 413 to intermediate transfer belt 421 (primary transfer) so as to superimpose the four color toner images on intermediate transfer belt 421, and then transferring the superimposed toner images to sheets (secondary transfer).

Image forming apparatus 1 employs a tandem mode in which photoconductor drums 413 corresponding to YMCK four colors are arranged in series in the running direction of intermediate transfer belt 421, and respective color toner images are successively transferred to intermediate transfer belt 421 in a single procedure.

As illustrated in FIG. 2, image forming apparatus 1 includes image reading section 10, operation/display section 20, image processing section 30, image forming section 40, sheet conveying section 50, fixing section 60, and control section 100, for example.

Control section 100 includes central processing unit (CPU) 101, read only memory (ROM) 102, and random access memory (RAM) 103, for example. CPU 101 reads a program corresponding to processing details from ROM 102, loads the program into RAM 103, and performs, cooperatively with the loaded program, centralized control of operations of the respective blocks of image forming system 1. During this step, various data stored in storage section 72 are referred to. Storage section 72 is composed of, for example, a nonvolatile semiconductor memory (so-called flash memory) and/or a hard disk drive.

Control section 100 transmits and receives various data to and from an external apparatus (personal computer, for example) connected to a communication network, such as a local area network (LAN) or a wide area network (WAN), via communication section 71. Control section 100, for example, receives image data transmitted from an external apparatus, and causes toner images to be formed on sheets on the basis of the image data (input image data). Communication section 71 is composed of, for example, a network interface card, such as a LAN adapter.

Image reading section 10 includes auto document feeder (ADF) 11 and document image scanner 12, for example.

Auto document feeder 11 conveys, by a conveying mechanism, document D placed on a document tray and sends it out to document image scanner 12. Auto document feeder 11 can simultaneously and continuously read images on many documents D (both sides included) placed on the document tray.

Document image scanner 12 optically scans documents conveyed from auto document feeder 11 onto a contact glass or documents placed on a contract glass, and images reflected light from the documents on a light receiving surface of charge coupled device (CCD) sensor 12*a* to read document images. Image reading section 10 generates input image data based on results read by document image scanner 12. The input image data undergoes predetermined image processing in image processing section 30.

Operation/display section 20 is composed of, for example, a touch panel-type liquid crystal display (LCD), and functions as both display section 21 and operation section 22. Display section 21 displays, for example, various operation screens, the state of images, the operation status of each function in accordance with display control signals input from control section 100. Operation section 22 equipped with various operation keys, such as a numeric keypad and a start key, receives various input operations by a user and outputs operation signals to control section 100.

Image processing section 30 includes, for example, a circuit that performs digital image processing of input image data in accordance with default settings or user settings. For example, image processing section 30 performs tone correction based on tone correction data (tone correction table LUT) in storage section 72 under the control of control section 100. Moreover, image processing section 30 performs, for example, various correction processing, such as color correction or shading correction, in addition to tone correction, and/or compression processing of input image data. Image forming section 40 is controlled on the basis of the thus-processed image data.

Image forming section 40 includes, for example, intermediate transfer unit 42 and image forming units for forming images of color toners of Y component, M component, C component, and K component, on the basis of input image data.

Image forming units 41Y, 41M, 41C, and 41K for Y component, M component, C component, and K component have similar configurations. For the purpose of convenience in illustration and description, common components are denoted by the same numerals while the numerals are accompanied by Y, M, C, or K when they are distinguished from each other. In FIG. 1, only components of image forming unit 41Y for Y component are denoted by numerals, and numerals are omitted for components of other image forming units 41M, 41C, and 41K.

Image forming unit 41 includes exposing device 411, developing device 412, photoconductor drum 413, charging device 414, and drum cleaning device 415, for example.

Photoconductor drum 413 is, for example, a negative-charging organic photoconductor (OPC) formed by successively stacking an undercoat layer (UCL), a charge generation layer (CGL), and a charge transport layer (CTL) on a peripheral surface of an aluminum conductive cylinder (aluminum tube). The charge generation layer is formed of an organic semiconductor in which a charge generation material (phthalocyanine pigment, for example) is dispersed in a resin binder (polycarbonate, for example), and generates pairs of positive and negative charges upon exposure by exposing device 411. The charge transport layer is formed of a hole transport material (electron-donating nitrogen compound) dispersed in a resin binder (polycarbonate, for example), and transports positive charges generated in charge generation layer to the surface of the charge transport layer.

Control section 100 causes photoconductor drum 413 to rotate at a constant peripheral speed (linear velocity) by controlling driving current supplied to a driving motor (not shown) for rotating photoconductor drum 413.

Charging device 414 evenly and negatively charges the surface of photoconductor drum 413. Exposing device 411 is composed of a semiconductor laser, for example, and irradiates photoconductor drum 413 with laser beams corresponding to images of the respective color components. Electrostatic latent images of the respective color components are thus formed on the surface of photoconductor drum 413 due to potential differences from the surroundings.

Developing device 412 is, for example, a developing device of a two-component developing system, and forms a toner image by attaching toners of the respective color components to the surface of photoconductor drum 413 to visualize electrostatic latent images.

Drum cleaning device 415 includes, for example, a cleaning member to be slid on the surface of photoconductor drum 413. Drum cleaning device 415 removes transfer residual toner on the surface of photoconductor drum 413 by a cleaning blade after primary transfer.

Intermediate transfer unit 42 includes intermediate transfer belt 421, primary transfer roller 422, a plurality of support rollers 423, secondary transfer roller 424, and belt cleaning device 426, for example.

Intermediate transfer belt 421 is formed of an endless belt, and looped around a plurality of support rollers 423 under tension. At least one of a plurality of support rollers 423 is a driving roller, and the rest are driven rollers. For example, roller 423A disposed on the downstream side of primary transfer roller 422 for K component in the running direction of the belt is preferably a driving roller. Such a configuration facilitates the retention of a constant running speed of the belt in a primary transfer section. Intermediate transfer belt 421 runs in arrow A direction at a constant speed by the rotation of driving roller 423A.

Primary transfer roller 422 is disposed, on the side of an inner peripheral surface of intermediate transfer belt 421, so as to face photoconductor drum 413 of each color component. A primary transfer nip, for transferring a toner image to intermediate transfer belt 421 from photoconductor drum 413, is formed by pressing primary transfer roller 422 against photoconductor drum 413 via intermediate transfer belt 421.

Secondary transfer roller 424 is disposed, on the side of an outer peripheral surface of intermediate transfer belt 421, so as to face backup roller 423B that is disposed on the downstream side of driving roller 423A in the running direction of the belt. A secondary nip, for transferring a toner image to sheet S from intermediate transfer belt 421, is formed by pressing secondary transfer roller 424 against backup roller 423B via intermediate transfer belt 421.

The secondary transfer nip formed from intermediate transfer belt 421, backup roller 423B, and secondary transfer roller 424 corresponds to "transfer section" of the present invention.

When intermediate transfer belt 421 passes through the primary transfer nips, toner images on photoconductor drums 413 are successively superimposed and transferred to intermediate transfer belt 421 (primary transfer). Specifically, toner images are electrostatically transferred to intermediate transfer belt 421 by applying primary transfer bias to primary transfer roller 422 thereby imparting charges of opposite polarity to toners to a contact side with primary transfer roller 422 of intermediate transfer belt 421.

Subsequently, when sheet S passes through the secondary transfer nip, toner images on intermediate transfer belt 421 are transferred to sheets (secondary transfer). Specifically, toner images are electrostatically transferred to sheets by applying secondary transfer bias to secondary transfer roller 424 thereby imparting charges of opposite polarity to toners to a contact side with secondary transfer roller 424 of sheets. Sheets bearing the transferred toner images are then conveyed to fixing section 60.

Belt cleaning device 426 includes, for example, belt cleaning blade that slide on the surface of intermediate transfer belt 426, and removes transfer residual toner on the surface of intermediate transfer belt 421 after secondary transfer.

Fixing section 60 includes, for example, upper fixing section 60A equipped with a fixing surface-side member that is disposed on a fixing surface side of a sheet, and lower fixing section 60B equipped with a rear surface-side support member that is disposed on a side opposite to the fixing surface side of the sheet, and a heating source 60C. A fixing nip, for pinching and conveying sheets, is formed by pressing the rear surface-side support member against the fixing surface-side member.

Fixing section 60 heats and presses conveyed sheets in which toner images have been transferred (secondary transfer), thereby fixing the toner images on the sheets. Fixing section 60 is disposed, as a unit, inside fixing device F.

Sheet conveying section 50 includes sheet feeding section 51, sheet ejection section 52, and conveying path section 53, for example. Three sheet feed tray units 51*a* to 51*c*, which constitute sheet feeding section 51, store sheets S (standard paper, special paper) classified based on basis weight (stiffness) and/or size, for example, in accordance with predetermined types. Conveying path section 53 includes a plurality of conveyance rollers, such as registration roller pair 53*a* and looping rollers 53*b*, and a reversing conveying path for forming images on both sides of sheets. Registration roller pair 53*a* corresponds to "sheet conveying member" of the present invention.

Registration roller pair 53*a* corrects a position of sheet S in the width direction under control of control section 100.

Specifically, once sheet S is pinched by a nip of registration roller pair 53*a*, registration displacement control that moves sheet S by moving registration roller pair 53*a* in the width direction is performed. Consequently, a position of sheet S in the width direction is corrected. Details of such registration displacement control will be described hereinafter.

Looping rollers 53*b* are a roller pair disposed on the upstream side of registration roller pair 53*a* in the conveying direction. Looping rollers 53*b* correct obliqueness of sheet S by rotating so as to form a loop of sheet S between registration roller pair 53*a* and looping rollers 53*b* under control of control section 100.

Registration roller pair 53*a* is separated from each other after a position of sheet S has been corrected and before sheet S passes out of registration roller pair 53*a*, i.e., during conveyance of sheet S, and returned to the original position before its movement. Registration roller pair 53*a* is then pressed against each other again after the rear end of sheet S has passed through registration roller pair 53*a*.

Under control of control section 100, a conveying speed of sheet S at registration roller pair 53*a* is set to be faster than a conveying speed of sheet S at a secondary transfer nip, which is formed by backup roller 423B and secondary transfer roller 424.

Line sensor 54 is disposed on the downstream side of registration roller pair 53*a* and on the upstream side of the secondary transfer nip in the conveying direction of sheets. Line sensor 54 is a sensor composed of linearly aligned photoelectric conversion elements, and serves to detect either edge of sheet S in the width direction (hereinafter, referred to as side edge) and thus to detect leaning of sheet S (shifts from a reference position).

Sheets S stored in sheet feed tray units 51*a* to 51*c* are each sent out from the uppermost portion one by one and conveyed to image forming section 40 through conveying path section 53. In this step, sloping of fed sheet S is corrected (skew correction) while a conveying timing is adjusted.

Toner images on intermediate transfer belt 421 are then transferred collectively to either side of sheet S in image forming section 40 (secondary transfer), and a fixing step is performed in fixing section 60. Sheet S bearing a formed image is ejected outside the apparatus by sheet ejection section 52 equipped with sheet ejection rollers 52*a*. During duplex printing, sides of sheet S, on whose first side an image has been formed, are reversed by passing through a reversing conveying path, a toner image is transferred to a second side (secondary transfer) and fixed, and then sheet S is ejected outside the apparatus by sheet ejection section 52.

Meanwhile, an image forming apparatus has a problem in which a phenomenon that a conveying direction of a sheet bends toward the sub-scanning direction (sub-scanning obliqueness) occurs due to misalignment among registration roller pair 53*a*, a secondary transfer nip, and a fixing nip. In addition to the misalignment, such sub-scanning obliqueness also tends to occur when diameters in both ends of a roller in the width direction of a sheet (sub-scanning direction) differ due to wear, for example. Further, long paper, whose size is long in the conveying direction, is susceptible to such effects and thus sub-scanning obliqueness occurs noticeably (see FIG. 3A). Since such sub-scanning obliqueness causes image defects due to shifting and/or distortion, for example, of images to be transferred in a transfer section, there is a need for a technique that reduces sub-scanning obliqueness.

In view of the above, conventional registration displacement control, in which a position of the side edge of sheet S detected by line sensor 54 is monitored and registration roller pair 53*a* is displaced when such positional shift of the side edge occurs, has been performed. Such conventional registration displacement control has focused on displacement control of registration roller pair 53*a* before the leading end of sheet S enters into the transfer section. The conventional registration displacement control will be described with reference to FIGS. 3A and 3B.

Figure 3A:
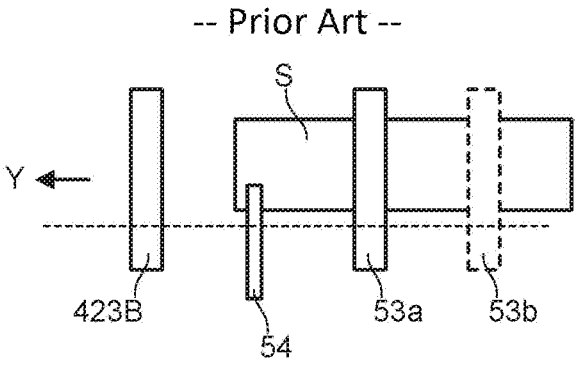
FIGS. 3A and 3B illustrate conventional registration displacement control, where
Figure 3B:
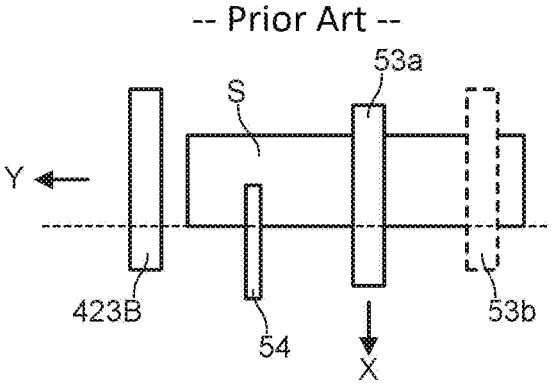

FIGS. 3A and 3B illustrate conventional registration displacement control when long paper is conveyed as sheet S. In each figure, the conveying direction of a sheet is denoted by arrow Y, a reference edge position of a sheet detected by line sensor 54 is represented by a dotted line, and a displacement direction of registration roller pair 53*a* is denoted by arrow X. Rollers being separated from sheets S are illustrated with dotted lines.

FIG. 3A illustrates an example in which sheet S (long paper) is conveyed while being shifted to the right side (rear side) as a whole on the upstream side of backup roller 423B, which forms a secondary transfer nip. In this case, control section 100 detects, from output signals of line sensor 54, a shifting direction and an amount of shifting of the side edge of sheet S and calculates displacement direction and amount for registration roller pair 53*a* on the basis of such detected results. Control section 100 then performs control, according to the calculated values, such that registration roller pair 53*a* is displaced in direction X orthogonal to sheet conveying direction Y as illustrated in FIG. 3B.

In order to perform such registration displacement control, control section 100 controls rollers (looping rollers 53*b* in the examples of FIGS. 3A and 3B) on the upstream side of registration roller pair 53*a* in the conveying direction such that the rollers are separated from sheet S. Accordingly, around the time when displacement of registration roller pair 53*a* is performed, sheet S is conveyed only by registration roller pair 53*a*.

In the conventional registration displacement control, displacement operations of registration roller pair 53*a* are performed only before the leading end of sheet S enters into a secondary transfer nip. Accordingly, when sub-scanning obliqueness (oblique running, for example) occurs after registration displacement, there is a problem in which shifting and/or distortion, for example, of images arise. Particularly, in the case of long paper, this problem becomes noticeable as the length of sheet S becomes longer.

When skew correction is performed against sloping (oblique running) of sheet S by registration roller pair 53*a*, the leading end side of sheet S is corrected, but the sloping in the sheet rear end cannot be corrected in the case of long paper. Accordingly, distortion remains on the leading end side and the rear end side, and thus sub-scanning obliqueness tends to occur.

In order to deal with such a problem, it may be possible to perform registration displacement control repeatedly after the leading end of sheet S (long paper) has entered into the secondary transfer nip.

In the conventional registration displacement control, however, a shift of the side edge of sheet S from a reference position is basically detected by line sensor 54, an amount of displacement for registration roller pair 53 is determined from the detected result, and registration roller pair 53*a* is displaced by the determined value. Therefore, in the conventional registration displacement control, the side edge of sheet S is shifted from a reference position, in some cases, when the displacement is terminated.

Particularly, when the size of sheet S is long in the conveying direction, the secondary transfer nip and/or the fixing member on the downstream side, as well as other conveyance rollers without separation mechanisms (sheet feed rollers of an optional apparatus, for example) on the upstream side, in some cases, are brought into contact with or pressed against the sheet during displacement of registration roller pair 53*a*. In such a case, the conventional registration displacement control, in which registration roller pair 53*a* is displaced by an amount of shifting of the side edge of sheet S detected by line sensor 54, tends to cause an excessive or a deficient amount of displacement.

In view of this problem, in the embodiment, registration displacement control similar to the above-described conventional one is performed when the length of sheet S in the conveying direction is equal to or shorter than a value set in advance (predetermined value), whereas registration displacement control below (termination control) is performed when the length of sheet S in the conveying direction exceeds the predetermined value. In other words, in the embodiment, control section 100 performs control such that displacement of registration roller pair 53*a* is terminated on the basis of detected results by line sensor 54 after displacement of registration roller pair 53*a*, i.e., movement in the width direction of sheet S, has been started.

As for the length of sheet S in the conveying direction, a length exceeding a predetermined value herein means that a sheet of such a length cannot be stored in sheet feed tray units 51*a* to 51*c* inside the apparatus, as well as in a sheet feed tray of a sheet feeding apparatus (not shown) connected with image forming apparatus 1 as an optional apparatus. The examples include a case in which the size of sheet S in the conveying direction exceeds 487.7 mm. Long paper of such a size can be fed by connecting a sheet feeding apparatus dedicated for such long paper (not shown) with image forming apparatus 1.

Alternatively, as for the length of sheet S in the conveying direction, a length exceeding a predetermined value herein means a length equal to or longer than a distance from a position of registration roller pair 53*a* to a roller that is provided on the upstream side of registration roller pair 53*a* in the conveying direction and constantly pressed against the sheet due to the absence of a pressing/separation mechanism.

This means that other rollers, such as looping rollers 53*b*, provided on the upstream side of registration roller pair 53*a* are controlled so as to be separable in the conventional registration displacement. In other words, in the conventional registration displacement control, only registration roller pair 53*a* is pressed against sheet S and registration roller pair 53*a* is displaced in a state without thrust resistance. For sheet S (long paper) long in the conveying direction as described above, however, the rear end side of the sheet is pressed by sheet feed rollers or the like in some cases when the leading end side of the sheet is pinched by registration roller pair 53*a*. In such a case, a position on the rear end side of the sheet cannot be corrected.

The registration displacement control according to the embodiment is particularly effective in such a case since the rear end of sheet S can reach a target value, i.e., reference position, even when sheet S is pressed by a plurality of rollers on the upstream side and on the downstream side of registration roller pair 53*a*.

Figure 4A:
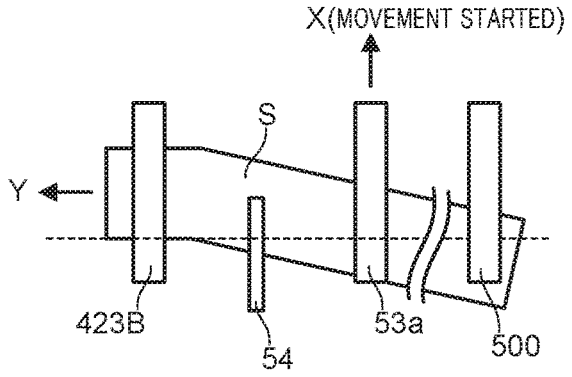
FIGS. 4A and 4B illustrate the outline of registration displacement control of the embodiment when long paper is conveyed, where
Figure 4B:
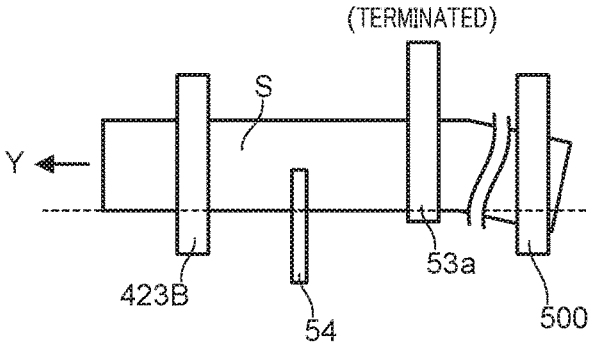

With reference to FIGS. 4A and 4B, the registration displacement control of the embodiment will be described further specifically. FIGS. 4A and 4B illustrate the registration displacement control of the embodiment when long paper is conveyed as sheet S. In each figure, the conveying direction of a sheet is denoted by arrow Y, a reference edge position of a sheet detected by line sensor 54 is represented by a dotted line, and a displacement direction of registration roller pair 53*a* is denoted by arrow X. In this example, it is assumed that a sheet feeding apparatus, as an optional apparatus (not shown), is connected with image forming apparatus 1 of FIG. 1, and sheet feed roller 500 of such a sheet feeding apparatus is disposed on the upstream side of registration roller pair 53*a*.

Characteristic registration displacement control of the embodiment is preferably performed after the leading end of sheet S has entered the secondary transfer nip, which is formed by backup roller 423B and the like, as illustrated in FIGS. 4A and 4B. As an example, control section 100 causes registration roller pair 53*a* to be displaced by a control technique similar to the above-described conventional one before the leading end of sheet S enters the secondary transfer nip (see FIGS. 3A and 3B). Subsequently, around the time when the leading end of sheet S enters the secondary transfer nip, control section 100 starts displacement of registration roller pair 53*a*, i.e., movement in the width direction. Each operation that starts displacement may be performed on the basis of detection signals of line sensor 54. Alternatively, such an operation that starts displacement may be performed on the basis of preset values described hereinafter.

The example of FIG. 4A exaggeratedly illustrates a case in which a portion of sheet S other than the leading end side in the conveying direction is shifted to the left. Such shifting of sheet S (shifting direction) can be detected by line sensor 54 as shifting of the side edge position. Alternatively, when the shifting direction of sheet S is known in advance (predictable) due to intrinsic properties of every equipment, timings of displacing registration roller pair 53*a* (in other words, positions of sheet S in the conveying direction, referred to as "displacement points" hereinafter) and displacement directions may be specified in advance as preset values.

As described above, sub-scanning obliqueness generally differs in a manner of obliqueness and/or an amount of obliqueness corresponding to individual differences among machines, such as alignment or a difference between the front and rear ends of each roller. After image forming apparatus 1 is installed in a room or the like, however, a mode of sub-scanning obliqueness basically does not change substantially, and it is common that each machine has a certain manner of obliqueness or a certain amount of obliqueness. The present inventors conducted various experiments on the basis of such findings. As a result, the present inventors found that timings of performing registration displacement basically need not rely on detection results of line sensor 54, and registration displacement control may be performed on the basis of preset values that specify displacement timings in advance.

In the configuration described hereinafter, control section 100 performs registration displacement control without using line sensor 54 for starting displacement of registration roller pair 53*a*, but rather using preset values that specify displacement timings for registration roller pair 53*a*. In other words, control section 100 controls registration roller pair 53*a* by using the preset values such that sheet S is displaced in the width direction orthogonal to a sheet conveying direction.

The preset values herein are values for setting displacement timings for registration roller pair 53*a* after the leading end of sheet S enters into registration roller pair 53*a* (hereinafter, also referred to as a registration nip) and until sheet S passes out of the registration nip.

For the sake of simplicity, a case in which preset values are specified as values that represent timings of moving registration roller pair 53*a* in the sheet width direction (displacement timings) after sheet S has started to enter into the secondary transfer nip will be described. Such displacement timings may be set as a plurality of timings for one sheet S. When a plurality of displacement timings are set for one sheet S, intervals between the timings may be set optionally.

Displacement timings herein refers to values that represent time for moving registration roller pair 53*a* in the width direction (moving start time), in other words, values that represent a distance of sheet S being conveyed by the secondary transfer nip when registration roller pair 53*a* is moved in the width direction. For the sake of convenience, by replacing displacement timings with displacement points, preset values for long paper specify a plurality of displacement points (positions in direction Y of FIGS. 4A and 4B) in which registration roller pair 53*a* is displaced after sheet S has been entered into the secondary transfer nip. In general, the preset values include a value that specifies, over the full length of sheet S in the conveying direction, timings of starting movement of registration roller pair 53*a* in the sheet width direction or points on sheet S.

In the embodiment, displacement start timings and the frequency of displacement (the number of displacement points) of registration roller pair 53*a* for one sheet S may be set freely by the above-described preset values.

Further, the preset values may include a value that represents a moving direction of registration roller pair 53*a*. Such a value that represents a moving direction is a value that indicates an opposite direction to the direction in which a positional shift of sheet S (in other words, sub-scanning obliqueness) occurs, and may be specified for every displacement timing (displacement point). When the direction of sub-scanning obliqueness of sheet S is known in advance due to unique characteristics of equipment or the like regardless of image forming conditions, such as types of sheets S, a value that represents a moving direction of registration roller pair 53*a* need not be included.

The preset values may further include a value that represents a moving speed (displacement speed) of registration roller pair 53*a*. Such a displacement speed value may be specified for every displacement timing (displacement point). The displacement speed may be constant or may be accelerated and/or decelerated.

As in the foregoing, when a print job is performed, control section 100 performs control using the above-described preset value such that registration roller pair 53*a* is started moving in the opposite direction (in the right direction in the example illustrated in FIG. 4A) to the shifting direction of sheet S. Through such control, while the leading end side of sheet S is pinched by the secondary transfer nip and conveyed whereas the rear end side of sheet S is pressed by sheet feed roller 500 and fed/conveyed, a portion of sheet S between the leading end side and the rear end side moves in the width direction while being pinched by registration roller pair 53*a*.

Subsequently, control section 100 turns on line sensor 54 to start detection of a side edge position of sheet S and terminates displacement of registration roller pair 53*a* on the basis of the detected results. Specifically, control section 100 monitors detection signals of line sensor 54 and controls registration roller pair 53*a* such that the displacement, i.e., movement in the width direction, is terminated when the side edge of sheet S reaches a reference position (hereinafter, also referred to as a target position) represented with a dotted line in FIG. 4B. By performing such termination control of registration roller pair 53*a*, it is possible to align the side edge of sheet S with a target position, thereby correcting sub-scanning obliqueness of sheet S more accurately than ever before.

Figure 5A:
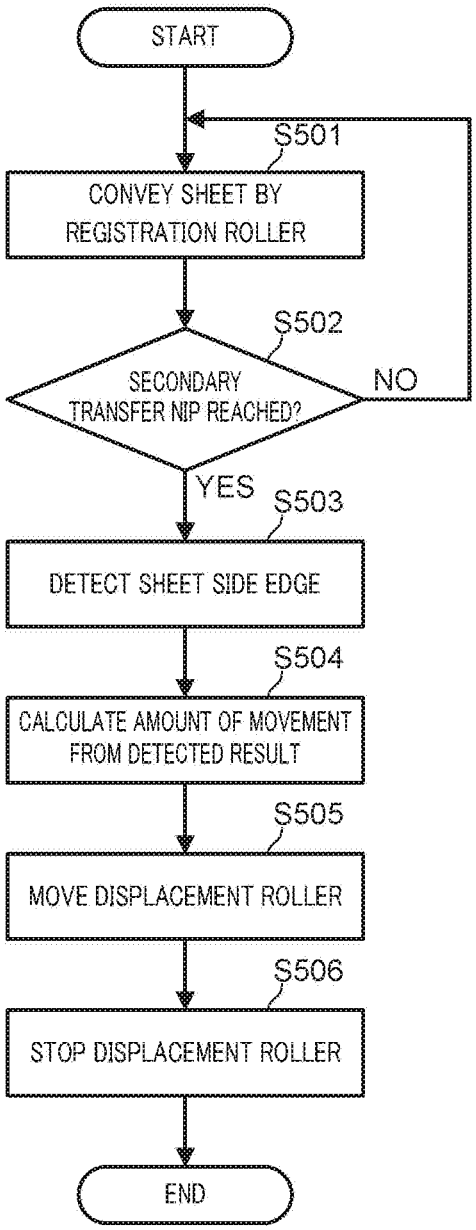
FIGS. 5A and 5B illustrate the registration displacement control of the embodiment through comparison with a conventional control technique, where
Figure 5B:
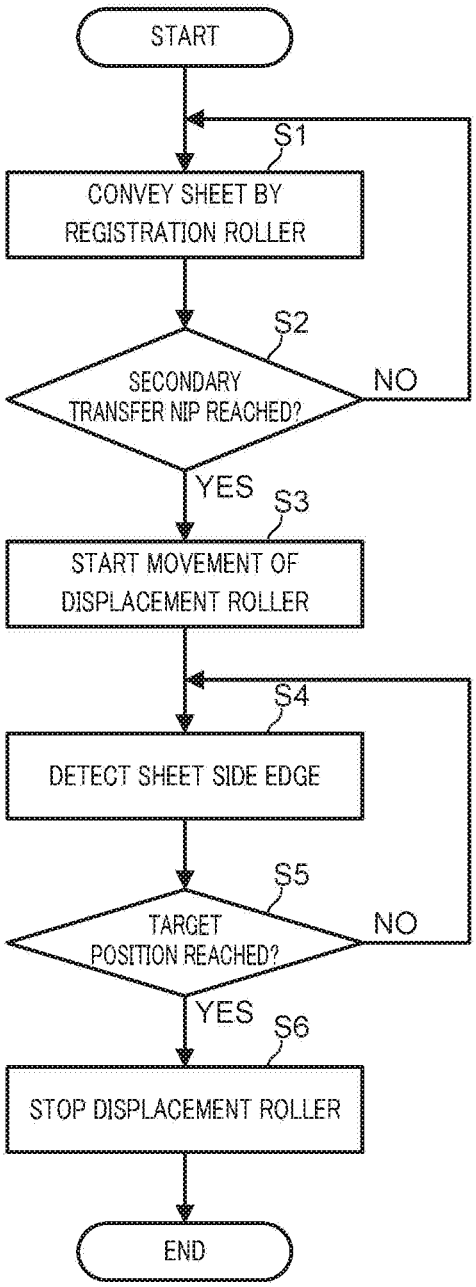

Next, with reference to FIGS. 5A, 5B, 6A, and 6B, the registration displacement control of the embodiment will be described further specifically through comparison with the conventional registration displacement control. FIG. 5A shows a procedure for registration displacement control, in which displacement operations are performed using the conventional control technique after sheet S has entered the secondary transfer nip, and FIG. 5B shows a procedure for registration displacement control of the embodiment.

Figure 6A:
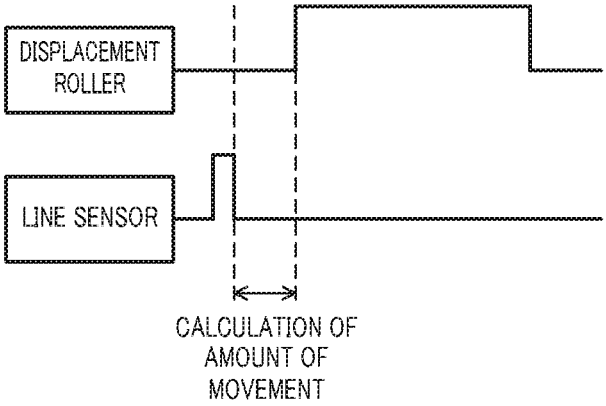
FIGS. 6A and 6B are timing charts illustrating operation examples of line sensors corresponding to FIGS. 5A and 5B, where
Figure 6B:
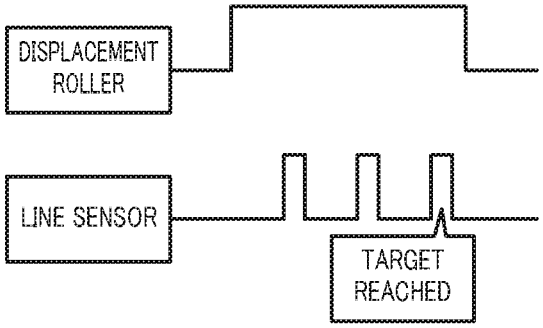

FIG. 6A illustrates a signal sequence in the registration displacement by the conventional control technique shown in FIG. 5A, whereas FIG. 6B illustrates a signal sequence in the registration displacement control of the embodiment. FIGS. 6A and 6B each illustrate a control signal that is output for displacement operations of registration roller pair 53*a* in the upper side, and a control signal that is output to line sensor 54 in the lower side. Each raised state of a signal is on-state. This means that registration roller pair 53*a* is moved in the width direction during the on-state for displacement, and the side edge of sheet S is detected during the on-state of line sensor 54.

As shown in FIG. 5A, in the conventional registration displacement control, sheet S is conveyed toward the secondary transfer nip once a print job is started (step S501), and whether sheet S has reached the secondary transfer nip is determined when the leading end of sheet S enters into registration roller pair 53*a* (step S502). When the leading end of sheet S is determined to have reached the secondary transfer nip (step S502, YES), a side edge position of sheet S (positional shift) is detected by line sensor 54 (step S503). Control section 100 thus calculates, from the detected results, an amount of movement for registration roller pair 53*a* (hereinafter, also referred to as "displacement rollers") (step S504), and performs control such that the displacement rollers are moved in the width direction and stopped corresponding to the calculated results (steps S505 and S506).

As illustrated in FIG. 6A, in the conventional registration displacement control, line sensor 54 is operated before displacement of the displacement rollers is started, an amount of displacement for the displacement rollers is calculated during the period represented by the double-headed arrow in the figure, and movement of the displacement rollers is started after the calculation (step S505). Control section 100 then performs control such that the movement of the displacement rollers is terminated when the movement by the calculated amount of displacement is completed (step S506). In other words, in the conventional registration displacement control, detected results of the side edge of sheet S by line sensor 54 is used only for starting movement of the displacement rollers and calculating an amount of the movement.

Accordingly, in the conventional registration displacement control, a time lag occurs due to processing time for calculating an amount of movement for displacement rollers, i.e., the period from detection by line sensor 54 until movement of the displacement rollers is started as represented by the double-headed arrow in FIG. 6A. When such a time lag is prolonged, a discrepancy (error) is more likely to arise between a positional shift during the measurement and a positional shift at the start of displacement. Accordingly, there is a problem in which the side edge of sheet S tends to be shifted from a target position (see the dotted lines in FIGS. 3A and 3B) when the movement of the displacement rollers is terminated.

Further, in the conventional registration displacement control, an amount of movement (amount of displacement) for the displacement rollers has already been determined when the movement of the displacement rollers is started (step S505). Accordingly, when long paper that is long in the conveying direction such that the leading end side or the rear end side of sheet S is pressed by rollers other than the displacement rollers is fed, sheet S is slipped from the displacement rollers during displacement operations, and thus, in some cases, positional shifts cannot be corrected by the determined amount of displacement (insufficient displacement).

As described above, according to the conventional registration displacement control in which line sensor 54 is used for calculating an amount of displacement and for starting displacement of the displacement rollers, the side edge of sheet S is not aligned with a target position in some cases when displacement of the displacement rollers is terminated, and errors tend to occur particularly when long paper is conveyed.

In contrast, the registration displacement control of the embodiment can substantially decrease such errors in registration displacement since line sensor 54 is used for terminating displacement of the displacement rollers.

Hereinafter, the procedure for the registration displacement control of the embodiment will be described with reference to FIG. 5B. In the registration displacement control of the embodiment, sheet S is conveyed toward the secondary transfer nip (step S1) when a print job is started, and whether sheet S has reached the secondary transfer nip is determined when the leading end of sheet S enters into registration roller pair 53*a* (step S2). The procedure in step S1 and step S2 is similar to that in the above-described step S501 and step S502 of FIG. 5A.

Meanwhile, in the embodiment, control is performed such that displacement of the displacement rollers, i.e., movement in the width direction, is started regardless of detected results by line sensor 54 (step S3) once control section 100 determines that the leading end of sheet S has reached the secondary transfer nip (step S2, YES). In the embodiment, line sensor 54 is operated to detect the side edge of sheet S after displacement of the displacement rollers has been started (step S4). Subsequently, control section 100 determines, on the basis of detected results by line sensor 54, whether the side edge of sheet S has reached a target position (step S5), and terminates the displacement of the displacement rollers (step S6) once the target position is determined to have been reached (step S5, YES).

In an example registration displacement control of the embodiment, line sensor 54 is set to be off-state before the displacement of the displacement rollers is started (see FIGS. 5B and 6B) and set to be on-state so that detection of the side edge of sheet S is started after the displacement of the displacement rollers has been started.

In addition, in the embodiment, the movement of the displacement rollers is controlled to be stopped once the side edge of sheet S is aligned with a target position (see dotted lines of FIGS. 4A and 4B). FIG. 6B illustrates a case in which detection (sensing) of the side edge of sheet S by line sensor 54 is performed a plurality of times at a constant cycle after the displacement of the displacement rollers has been started, and the displacement rollers are stopped once the side edge of sheet S is aligned with a target position in the third sensing. As another control example, control section 100 may calculate (predict), from a first sensing result, a timing when the side edge of sheet S reaches a target position, and perform a second sensing at the calculated timing, or terminate the movement of the displacement rollers without the second sensing. Such termination control can decrease the operation frequency of line sensor 54 and thus extend the lifetime.

As in the forgoing, according to the embodiment in which detection signals of line sensor 54 are used for terminating displacement of the displacement rollers, the movement of the displacement rollers can be terminated once the side edge of sheet S is aligned with a target position. Through such control, sub-scanning obliqueness of sheets S can be corrected more accurately than ever before.

Hereinafter, specific examples of timings of performing displacement of registration roller pair 53*a* will be described.

As for rollers or the like that convey sheet S, sub-scanning obliqueness tends to occur when load variations in sheets S arise. Typically, when the leading end of sheet S enters into the secondary transfer nip, when the leading end of sheet S enters into a fixing nip of fixing section 60, and/or when the rear end of sheet S passes out of looping rollers 53*b*, relatively large load variations result, and such load variations tend to cause sub-scanning obliqueness of sheet S. Accordingly, the above-mentioned timings are specified as preset values in the embodiment, and control section 100 starts displacement of registration roller pair 53*a* according to such preset values and controls the above-described displacement termination on the basis of detected results by line sensor 54.

As for rollers or the like that convey sheets S, torque of motors, for example, that drive such rollers varies when load variations in sheets S arise. Accordingly, control section 100 may monitor the output of such motors when a print job is performed, start displacement of registration roller pair 53*a* once the torque exceeds a predetermined value, and perform the above-described displacement termination control on the basis of detected results by line sensor 54. In this case, a torque range (predetermined value), which becomes a trigger for starting displacement of registration roller pair 53*a*, may be specified as a preset value.

Meanwhile, when a print job is performed while image forming conditions, such as the surrounding environment of image forming apparatus 1 and types of sheets S used, vary, timings when sub-scanning obliqueness of sheets S occurs may vary in some cases. In this case, errors could occur if timings of starting displacement of registration roller pair 53*a* and/or intervals of displacement are uniformly applied. In other words, timings of starting displacement could be delayed or made earlier relative to the occurrence of sub-scanning obliqueness.

Therefore, control section 100 preferably changes, corresponding to image forming conditions, timings of starting displacement of registration roller pair 53*a* and/or intervals of displacement specified by preset values (correct preset values).

For example, control section 100 corrects preset values such that timings of starting displacement of registration roller pair 53*a* and/or intervals of displacement are changed corresponding to the surrounding temperature and humidity environment of image forming apparatus 1. Specifically, control section 100 monitors the output of a temperature/humidity sensor (not shown) inside the apparatus when a print job is performed, and corrects, corresponding to the output, timings of starting displacement and/or intervals in displacement specified by preset values.

As a correction technique, when the surrounding temperature and humidity environment of image forming apparatus 1 is more likely to cause sub-scanning obliqueness than usual (typically, higher humidity than usual), control section 100 corrects timings of starting displacement to make somewhat earlier.

In addition, when a plurality of timings of starting displacement (displacement points) are set for sheet S, control section 100 corrects each timing of starting displacement to make earlier by certain time or makes corrections so as to increase operations that start displacement (displacement frequency, i.e., the number of displacement points).

Further, control section 100 may change time values to be corrected between displacement points on the leading end side and the rear end side of sheet S, for example, by setting timings of starting displacement to be earlier at displacement points on the rear end side of sheet S in which sub-scanning obliqueness is more likely to occur. When sheet S is long paper, control section 100 may shorten intervals of displacement on the rear end side of sheet S in the conveying direction, relative to intervals in displacement on the leading end side of sheet S. In other words, displacement of registration roller pair 53*a* may be performed frequently on the rear end side of sheet S.

In general, as the length of sheet S in the conveying direction becomes longer, the displacement frequency of registration roller pair 53*a* (displacement points) needs to be increased. As a difference between front and rear roller diameters becomes larger, sheet S with a larger width is believed to be more affected (higher degree of oblique running, for example) by the difference in diameters. In addition, since sheets S with a high and a low gloss exhibit different slipping properties during conveyance while being pinched by a roller pair (slipperier for the former), timings of starting displacement and/or displacement frequency may need to be changed even for sheets of the same size. Further, since sheets S with a lower basis weight have a lower stiffness and thus become slippery during conveyance, timings of starting displacement and/or displacement frequency may need to be changed even for sheets of the same size.

Accordingly, control section 100 performs a procedure for correcting preset values so as to change timings of starting displacement of registration roller pair 53*a* and/or intervals of displacement corresponding to types of sheets S. Specifically, when a print job is performed, control section 100 identifies a type of sheet S to be conveyed from user setting information that determines a type of sheet S (size, such as length and/or width; gloss; basis weight (stiffness), for example) and/or a sheet feed tray unit (51*a* to 51*c*) to be used. Control section 100 then corrects values for timings of starting displacement and/or intervals of displacement specified by preset values so as to fit the identified type of sheet S.

As described above, appropriate timings of starting displacement of registration roller pair 53*a* vary in some cases corresponding to image forming conditions, such as types of sheets S. In view of this, preset values may be registered in individual tables corresponding to image forming conditions, such as types of sheets S, and control section 100 may identify a type of sheet S when a print job is performed, read a preset value in a corresponding table, and perform registration displacement control.

According to the embodiment in which registration displacement is performed using preset values as described above, control is performed so that displacement timings for registration roller pair 53*a* are determined in advance, the movement of the registration rollers is started as intended, and the movement is terminated on the basis of detected results by line sensor 54. According to the embodiment in which such registration displacement control is performed, sub-scanning obliqueness of sheets S due to misalignment, for example, can be corrected further accurately.

Hereinafter, tables in which preset values are to be registered will be described in further detail.

In the embodiment, the preset values specify, for example, suitable displacement timings for registration roller pair 53*a* in order to correct sub-scanning obliqueness of sheets S, i.e., positional shifts in the width direction.

Meanwhile, as described above, preferable displacement timings for registration roller pair 53*a*, for example, are believed to vary corresponding to types of sheets S (length, width, surface gloss, basis weight (stiffness), for example).

Accordingly, a table has a table structure in which preset values are registered for every type of sheet (length, width, surface gloss, basis weight, for example). In this case, when a print job is performed, control section 100 identifies a type of sheet S to be conveyed, from user setting information that determines a type of sheet S and/or a sheet feed tray unit to be used (51*a* to 51*c*, or a sheet feed tray of an optional apparatus), reads a preset value corresponding to the type of identified sheet S from the table, and performs the above-described registration displacement control.

Since types of sheets S vary widely as described above, tables in which preset values are to be registered may be provided corresponding to types of paper, in other words, tables may be provided for every type of sheet S as described above. In this case, when a print job is performed, control section 100 identifies a type of sheet S to be conveyed from the user setting information, reads a preset value registered in a table corresponding to the identified type of sheet S, and performs the above-described registration displacement control.

As in the foregoing, different types of sheets S are stored in different sheet feed tray units 51*a* to 51*c*. When sheets S are long paper, such sheets S are fed from a bypass tray or a sheet feed tray unit of an optional apparatus. Accordingly, a table may be configured so that preset values are registered for every sheet feed tray. Similarly, tables in which preset values are to be registered may be provided for every sheet feed tray.

In this case, when a print job is performed, control section 100 identifies a sheet feed tray to be used from the user setting information, reads a preset value corresponding to the identified sheet feed tray from a corresponding table, and performs the above-described registration displacement control.

Meanwhile, even when types of sheets S are the same, modes of positional shifts of images (amount of shifting, shifting direction, for example) that actually occur are believed to be different when the installation environment of image forming apparatus 1, typically temperature and humidity conditions, varies. In other words, preferable timings of displacing registration roller pair 53*a* for aligning the position of sheet S in the width direction with a target position and thus with a position of an image to be formed are believed to vary depending on temperature and humidity. Accordingly, a table may be configured so that preset values are registered corresponding to the surrounding temperature and humidity of image forming apparatus 1. Similarly, tables in which preset values are registered may be provided corresponding to the surrounding temperature and humidity of image forming apparatus 1, or may be provided, for example, for every numerical value range of temperature and humidity.

In this case, when a print job is performed, control section 100 identifies temperature and humidity from detected values by a temperature/humidity sensor (not shown) inside the apparatus, reads preset values corresponding to the identified temperature and humidity from a corresponding table, and performs the above-described registration displacement control.

Figure 7:
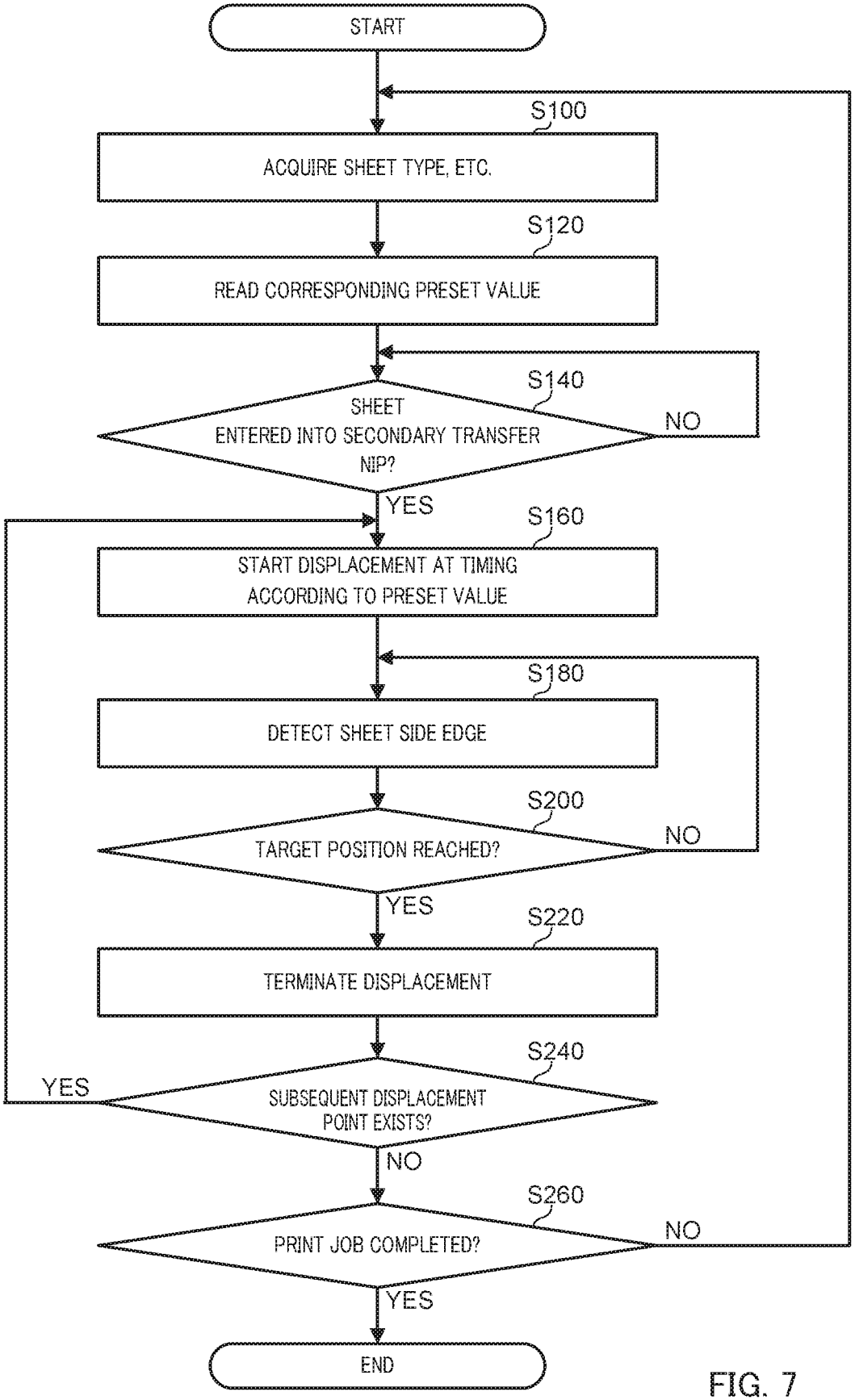
FIG. 7 is a flow chart showing an example conveyance control concerning registration displacement in the image forming apparatus of the embodiment.

Hereinafter, example operations concerning displacement control of registration roller pair 53*a* and thus sheets S in image forming apparatus 1 will be described with reference to the flow chart of FIG. 7. The example of FIG. 7 presupposes that displacement of registration roller pair 53*a* is started using preset values in view of the life of line sensor 54, for example. The flow chart of FIG. 7 is a case of long paper in which the size of sheet S in the conveying direction exceeds 487.7 mm, and the procedure is performed for every sheet S in which an image is to be formed when a print job is performed in image forming apparatus 1 that is connected with the above-mentioned sheet feeding apparatus dedicated for long paper.

When a print job is performed, control section 100 acquires, from user setting information of a print job, information on a type of sheet S (length, width, gloss, basis weight (stiffness), for example) in which printing is to be performed (step S100). Control section 100 here may additionally acquire information on other image forming conditions, such as temperature and humidity as described above.

In step S120, control section 100 reads a preset value, registered in a table, corresponding to the acquired image forming conditions (type of sheet in this example) and sets a displacement direction and displacement timing for registration roller pair 53*a*.

Control section 100 then waits until sheet S enters into the secondary transfer nip (step S140, NO), and moves to step S160 once sheet S enters into the secondary transfer nip (step S140, YES).

In step S160, control section 100 performs control such that displacement of registration roller pair 53*a*, i.e., movement in the width direction, is started according to a set value, i.e., preset value. Through such control, registration roller pair 53*a* is displaced, relative to sheet S that has entered into the secondary transfer nip, at timings corresponding to the preset value, and thus sheet S is displaced together with such displacement in the width direction.

At this moment, the leading end side of sheet S (long paper) is pinched by the secondary transfer nip and conveyed while a toner image is formed, whereas the rear end side of such long paper is conveyed while being pressed by sheet feed roller 500 inside a sheet feed tray unit of an optional apparatus dedicated for long paper (see FIG. 4A).

Subsequently, control section 100 starts detection of a side edge position of sheet S by turning on line sensor 54 (step S180), and determines whether the side edge of sheet S has reached a target position (see the dotted lines of FIGS. 4A and 4B) (step S200). Control section 100 continues such detection of positions until the side edge of sheet S is determined to have reached the target position (NO in step S200 and step S180), and moves to step S220 once the side edge of sheet S is determined to have reached the target position (see FIG. 4B) (step S200, YES).

In step S220, control section 100 controls registration roller pair 53*a* such that the displacement is terminated. Through such termination control, the side edge of sheet S can accurately be aligned with a target position (reference position), and thus sub-scanning obliqueness of sheets can be corrected more accurately than ever before.

After that, control section 100 determines whether a subsequent displacement point exists (step S240), returns to step S160 if a subsequent displacement point exists (step S240, YES), and repeats the procedure from step S160 to step S220 as described above.

Accordingly, when a plurality of displacement points are provided for sheet S, control for staring and terminating displacement of registration roller pair 53*a* is performed a plurality of times.

As in the foregoing, when displacement is also set to be performed after the leading end of sheet S has entered a fixing nip or after the rear end of sheet S has passed out of looping rollers 53*b*, control section 100 controls, in step S160, registration roller pair 53*a* such that the displacement is started at the above-mentioned timings.

Meanwhile, control section 100 moves to step S260 if a subsequent displacement point does not exist (step S240, NO).

In step S260, control section 100 determines whether a print job is completed. As a result of the determination, control section 100 returns to step S100 if a print job is yet to be completed (step S260, NO), and performs printing processes, such as displacement control of registration roller pair 53*a* and image formation, for the following sheet S. Meanwhile, control section 100 terminates the above series of processes if a print job is completed (step S260, YES).

In the embodiment, a control example, in which displacement termination control based on detected results of a side edge position of sheet S after the displacement of registration roller pair 53*a* has been started is performed after the leading end of sheet S has entered into the secondary transfer nip, is described. In contrast, displacement termination control based on detected results of a side edge position of sheet S after the displacement of registration roller pair 53*a* has been started may be performed before or until the leading end of sheet S enters into the secondary transfer nip. Although the example registration displacement control is described above primarily for a case in which sheet S is long paper, sheet S may be standard paper in the present invention.

Second Embodiment

Hereinafter, a control example of the second embodiment will be described. In the control example, control section 100 switches a first registration displacement control (first control) and a second registration displacement control (second control) corresponding to a position of sheet S in the conveying direction. In the first control, control section 100 aligns the edge of sheet S with a target position by displacing registration roller pair 53*a*, i.e., moving in the width direction, by an amount of displacement based on detected results by line sensor 54. Meanwhile, in the second control, control section 100 operates line sensor 54 after a displacement operation (movement in the width direction) of registration roller pair 53*a* has been started, and terminates the displacement operation on the basis of detected results by line sensor 54 such that the edge of sheet S reaches a target position.

The target position here is a position for forming an image in a correct position of sheet S at the secondary transfer nip, and corresponds to a position of the above-mentioned reference position in the first control (see the dotted line of FIG. 3B).

Meanwhile, as illustrated in FIGS. 1, 3A, and 3B, the secondary transfer nip, line sensor 54, and registration roller pair 53*a* of image forming apparatus 1 are located in different positions in the conveying direction. Accordingly, these components are misaligned in some cases, and thus fine adjustments in an amount of displacement for registration roller pair 53*a* may be needed corresponding to an amount of shifting after sheet S has entered into the secondary transfer nip. When sheet S is long paper, rollers other than registration roller pair 53*a* are pressed against sheet S in some cases during displacement of registration roller pair 53*a*. In this case, images may be formed in correct positions by slightly excessive displacement.

Accordingly, a target position in the second control is basically the same reference position as in the first control (position represented by the dotted line of FIG. 3B), but may be set in a position slightly shifted (zero point few mm-level, for example) to the right or the left side from the reference position corresponding to image forming conditions. A target position in the second control thus may be set in a different position from a target position in the first control. When a plurality of displacement operations of registration roller pair 53*a* are performed for one sheet S in the second control, control section 100 may set the same or different target positions for each displacement operation.

A timing of switching the first control and the second control may be set in various manners. Hereinafter, a case in which the first control is performed until the leading end of sheet S enters the secondary transfer nip (transfer section) and is switched to the second control when the leading end of sheet S enters the secondary transfer nip will be described.

The first registration displacement control (first control) of the embodiment employs a control technique similar to the control details described in connection with FIGS. 3A and 3B. In the first control, control section 100 can perform displacement operations of registration roller pair 53*a* in the width direction a plurality of times until the leading end of sheet S reaches the secondary transfer nip. In other words, in the first control, control section 100 repeats processes of calculating, once a positional shift of the side edge of sheet S is detected by line sensor 54, an amount of displacement for registration roller pair 53*a*, displacing registration roller pair 53*a* by the amount of displacement, and terminating the displacement.

In the embodiment, when the length of sheet S in the conveying direction is equal to or smaller than a preset value (predetermined value), the second control may be omitted by setting in advance through a user setting screen, for example. When such a setting is chosen, control section 100 only performs registration displacement control similar to the conventional one or the first control described above when the length of sheet S in the conveying direction is equal to or shorter than a predetermined value, and performs the first and the second registration displacement control if the length of sheet S in the conveying direction exceeds the predetermined value.

A case in which the length of sheet S in the conveying direction exceeds a predetermined value is a case in which sheet S is long paper as in the case of the first embodiment.

In other words, in a case of sheet S (long paper) that is long in the conveying direction as described above, when the leading end side of the sheet is pinched by registration roller pair 53*a*, the rear end side of the sheet is pressed by sheet feed rollers or the like in some cases. In such a case, a position of the sheet rear end side cannot be corrected.

In the second registration displacement control is particularly effective in such a case since the side edge of sheet S can be aligned with a target position even when sheet S is pressed by a plurality of rollers on the upstream side and on the downstream side of registration roller pair 53*a*.

In the embodiment, by performing the above-described first registration displacement control before the leading end of sheet S enters the secondary transfer nip, the leading end side of sheet S can be entered into the secondary transfer nip while being aligned in a correct position in the width direction (the reference position represented by the dotted line) as illustrated in FIG. 4A. Meanwhile, when sheet S is long paper, the rear end side is often shifted in the width direction even if the leading end side is aligned in a correct position. In view of this problem, in the embodiment, the second registration displacement control is performed after the leading end of sheet S has entered the secondary transfer nip. In other words, control section 100 starts displacement of registration roller pair 53*a*, i.e., movement in the width direction once the leading end of sheet S enters the secondary transfer nip. Such control for starting displacement may be performed by using detection signals of line sensor 54. In the embodiment, however, such control is performed using preset values that specify timings of moving registration roller pair 53*a* in the width direction.

The example of FIG. 4A exaggeratedly illustrates a state in which a position of a sheet S portion other than the leading end side in the conveying direction is shifted to the left. Such positional shifting direction and amount of sheet S can be detected by using line sensor 54. As in the foregoing, when the shifting direction of sheet S is known in advance (predictable), line sensor 54 need not be used for starting displacement of registration roller pair 53*a*. When the shifting direction of sheet S is predictable, one or more timings of starting displacement of registration roller pair 53*a* (i.e., displacement points) may be predetermined as preset values in the second control.

As described above, in general, modes of sub-scanning obliqueness differ corresponding to individual differences among machines, but basically do not change substantially after image forming apparatus 1 is installed in a room or the like. In addition, the positional shifting direction before the leading end of sheet S enters the secondary transfer nip is basically and typically the same as the shifting direction in position after the leading end of sheet S has entered the secondary transfer nip.

Accordingly, detection signals of line sensor 54 basically need not be used when displacement is started in the second registration displacement control (second control) for correcting sub-scanning obliqueness. Rather, such a step may be performed on the basis of preset values that specify displacement timings in advance.

Further, in the embodiment, control section 100 applies the displacement direction of registration roller pair 53*a* in the first control to the second control. In other words, control section 100 determines, before performing the second control, the moving direction of registration roller pair 53*a* in the second control on the basis of detected results by line sensor 54 during the first control.

Specifically, control section 100 sets the displacement direction of registration roller pair 53*a* in the second control to be the same as the displacement direction of registration roller pair 53*a* in the first control. For example, control section 100 determines that registration roller pair 53*a* is moved to the same direction, i.e., to the right side, in the second control when registration roller pair 53*a* is moved to the right side in the first control. Control section 100 then performs control such that registration roller pair 53*a* is started moving in the determined direction (the right side in the example above) in the second control after the leading end of sheet S has entered the secondary transfer nip. Subsequently, control section 100 terminates the displacement of registration roller pair 53*a* on the basis of detected results by line sensor 54 after the displacement (movement in the width direction) of registration roller pair 53*a* has been started.

In the embodiment, by performing two-stage registration displacement control, i.e., the first control and the second control, further highly accurate registration displacement control and further linear conveyance of sheets S, such as long paper, become possible. Consequently, the occurrence of image defects on sheets S can be prevented effectively.

Similar to the first embodiment described above, in the second registration displacement control, control section 100 does not use line sensor 54 when displacement of registration roller pair 53*a* is started, and performs registration displacement control using preset values that specify displacement timings for registration roller pair 53*a*. In other words, in the second control of registration displacement, control section 100 controls registration roller pair 53*a* by using the preset values (fixed values) such that sheet S is displaced in the width direction orthogonal to the sheet conveying direction.

In the embodiment, the preset values include a value that specifies timings or points on sheets S for starting movement of registration roller pair 53*a* in the width direction over the full length of sheet S in the conveying direction. In addition, the preset values may include a value on a shifting amount from each target position, i.e., reference position, at each displacement point.

In the embodiment, by setting preset values as described above, displacement operations of registration roller pair 53*a*, i.e., a timing of starting displacement, frequency of displacement (the number of displacement points), a displacement speed, and a target position, for example, in the second control may be set optionally for one sheet S regardless of the first control.

Hereinafter, the procedure for the first control and the second control in the registration displacement control of the embodiment will be described. Control section 100 conveys sheet S toward the secondary transfer nip once a print job is started, and a position of the side edge of sheet S is detected by line sensor 54 when the sheet S passes through line sensor 54. Accordingly, control section 100 calculates an amount of movement for registration roller pair 53*a* from such detected results, and performs the first control for moving registration roller pair 53*a* in the sheet width direction according to the calculated results. Through the first control, registration roller pair 53*a* is displaced in the opposite direction to the shifting direction of sheet S (the right direction in the example illustrated in FIG. 4A). In the first control, registration roller pair 53*a* may be displaced a plurality of times until the leading end of sheet S enters into the secondary transfer nip.

Meanwhile, control section 100 determines the displacement direction in the second control while the first control is performed, i.e., until the leading end of sheet S enters into the secondary transfer nip. For example, control section 100 stores, in a memory (RAM 103, for example), the displacement direction of registration roller pair 53*a* displaced in the first control.

Subsequently, control section 100 starts the procedure for the second control once the leading end of sheet S enters into the secondary transfer nip. Specifically, control section 100 causes displacement of registration roller pair 53*a* to be started at timings set by preset values. Through such control, while the leading end side of sheet S is pinched by the secondary transfer nip and conveyed whereas the rear end side of sheet S is pressed by sheet feed roller 500 and fed/conveyed, a portion of sheet S between the leading end side and the rear end side is moved in the width direction while being pinched by registration roller pair 53*a*.

Control section 100 then turns on line sensor 54 to start detection of a position of the side edge of sheet S and terminates displacement of registration roller pair 53*a* on the basis of the detected results. Specifically, control section 100 monitors detection signals of line sensor 54, and controls registration roller pair 53*a* so as to terminate the displacement, i.e., movement in the width direction, when the side edge of sheet S reaches a target position (a reference position represented by the dotted line of FIG. 4B, for example). By performing such termination control of registration roller pair 53*a*, the side edge of sheet S can be aligned with a target position, and sub-scanning obliqueness of sheet S can be corrected more accurately than ever before.

As in the foregoing, when sheet S is long paper and is pressed by rollers or the like other than registration roller pair 53*a* during displacement of registration roller pair 53*a*, an amount of displacement for registration rollers may need to be adjusted to be slightly larger in order to form images in correct positions of sheet S. In the conventional registration displacement control, such adjustment of an amount of displacement is not considered.

In contrast, in the second registration displacement control of the embodiment, displacement timings (displacement points) of sheet S are determined in advance, and stop positions of displacement rollers for forming images in correct positions of sheet S (an amount of offset of the side edge of sheet S from a reference position) may be set for every displacement point.

Hereinafter, the procedure for the registration displacement control of the embodiment will be described with reference to FIG. 5B. In the embodiment, sheet S is conveyed toward the secondary transfer nip once a print job is started (step S1). Once sheet S enters into registration roller pair 53*a*, control section 100 determines whether the leading end of sheet S has reached the secondary transfer nip (step S2). Until the leading end of sheet S reaches the secondary transfer nip, control section 100 performs positioning of the leading end side of sheet S by performing the first registration displacement control and thus displacing the displacement rollers once or a plurality of times by an amount of displacement based on detected results of the sheet side edge by line sensor 54.

Subsequently, if the leading end of sheet S is determined to have reached the secondary transfer nip (step S2, YES), control section 100 switches registration displacement control from the first control to the second control. In the second control, control section 100 starts displacement of displacement rollers, i.e., movement in the width direction, regardless of detected result by line sensor 54 (step S3). Further, in the second control, line sensor 54 is operated and the side edge of sheet S is detected after the displacement of the displacement rollers has been started (step S4). Subsequently, control section 100 determines, on the basis of detected results by line sensor 54, whether the side edge of sheet S has reached a target position (step S5), and terminates displacement of the displacement rollers (step S6) if the target position is determined to have been reached (step S5, YES).

The procedure from step S3 to step S6 may be performed a plurality of times corresponding to preset displacement timings (displacement points). In addition, target positions, i.e., stop positions of displacement rollers (offset values from reference positions), may be set or determined for each displacement point as described above. For the sake of simplicity, a target position at each displacement point will be described hereinafter as reference positions represented by the dotted lines of FIGS. 4A and 4B unless otherwise indicated.

In the embodiment, after the leading end of sheet S has reached the secondary transfer nip, i.e., during the period of the second control, line sensor 54 may be set to be off-state without being used before displacement of the displacement rollers is started, and set to be on-state so that detection of the side edge of sheet S is started after the displacement of the displacement rollers has been started.

In the second control, the movement of displacement rollers is controlled to be terminated once the side edge of sheet S is aligned with a target position (see the dotted lines of FIGS. 4A and 4B). FIG. 6B illustrates a case in which detection (sensing) of the side edge of sheet S by line sensor 54 is performed a plurality of times in a constant cycle after the displacement of the displacement rollers has been started, and the displacement rollers are stopped when the side edge of sheet S becomes aligned with a target position in the third sensing. As another control example, control section 100 may calculate (predict), from a first sensing result, a timing when the side edge of sheet S reaches a target position, and perform a second sensing at the predicted timing. Alternatively, control section 100 may omit the second sensing and terminate the movement of the displacement rollers (displacement operations) at the predicted timing. Such termination control can decrease the operation frequency of line sensor 54 and thus extend the lifetime.

As described above, according to the second control in which detection signals of line sensor 54 are used for terminating the displacement of the displacement rollers, the movement of the displacement rollers can be terminated once the side edge of sheet S is aligned with a target position. Through such control, sub-scanning obliqueness of sheets S, especially long paper, can be corrected more accurately than the conventional control, in other words, can be corrected so that the occurrence of image defects is prevented effectively.

Figure 8A:
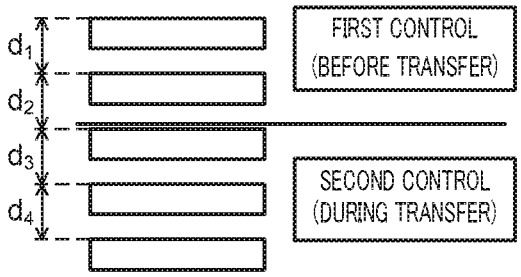
FIGS. 8A and 8B each illustrate a displacement operation for a registration roller pair according to a second embodiment, where
Figure 8B:
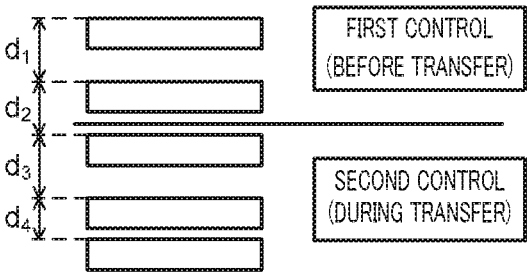

FIGS. 8A and 8B show displacement timings for registration roller pair 53*a* of the embodiment. In the examples shown, displacement control of registration roller pair 53*a* is assumed to be performed twice in the first control and three times in the second control. FIG. 8A shows a case in which displacement is performed at regular timings over the full length of sheet S, and thus intervals between start timings among the five displacement operations (i.e., periods of $d_1$, $d_2$, $d_3$, and $d_4$) are the same.

Meanwhile, FIG. 8B shows a case in which intervals between start timings for respective displacement operations in the second control (i.e., periods of $d_3$ and $d_4$) are set irregularly. In this example, the interval between the second and the third displacement start timings (period $d_4$) is shorter than the interval between the first and the second displacement start timings (period $d_3$) in the second control.

Considering that sub-scanning obliqueness (positional shift) tends to occur on the rear end side of a sheet when sheet S is long paper, preset values are preferably set so that displacement timings for registration roller pair 53*a* are concentrated or frequent on the rear end side of the sheet as shown in FIG. 8B. Each displacement timing (starting of movement) for registration roller pair 53*a* in the second control may be set to an appropriate timing by taking account of the probability of a positional shift and may be set regardless of the displacement timings for registration roller pair 53*a* in the first control.

Figure 9:
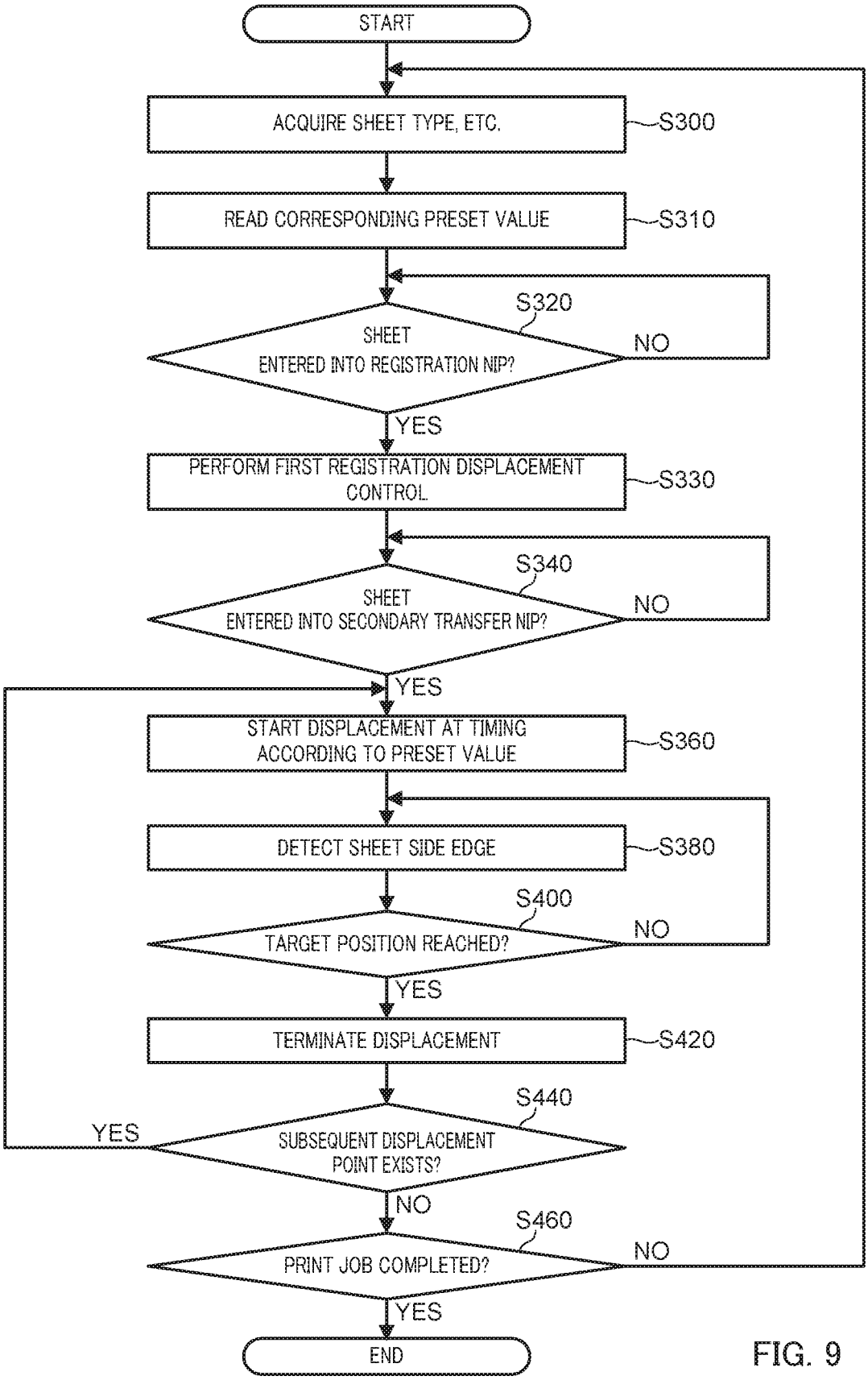
FIG. 9 is a flow chart showing an example conveyance control concerning registration displacement of the second embodiment.

Hereinafter, example operations concerning registration control of registration roller pair 53*a* and thus sheets S in image forming apparatus 1 will be described with reference to the flow chart of FIG. 9. The flow chart shown is a case of long paper in which the size of sheet S in the conveying direction exceeds 487.7 mm, and the procedure is performed for every sheet S in which an image is to be formed when a print job is performed in image forming apparatus 1 that is connected with the above-mentioned sheet feeding apparatus dedicated for long paper.

When a print job is performed, control section 100 acquires, from user setting information of a print job, information on a type of sheet S (length, width, gloss, basis weight (stiffness), for example) in which printing is to be performed (step S300). Control section 100 here may additionally acquire information on other image forming conditions, such as temperature and humidity as described above.

In step S310, control section 100 reads a preset value registered in a table corresponding to the acquired image forming conditions (a type of sheet in this example), and presets operation details of registration roller pair 53*a* in the second registration displacement control (second control). The operation details in the second control set here include a displacement start timing for each displacement operation. Control section 100 may appropriately correct a displacement start timing specified by a preset value and set a new displacement start timing. In addition, the above-mentioned displacement speed and/or target position for displacement termination in each displacement operation may be set together.

Subsequently, control section 100 waits until the leading end of sheet S enters into registration roller pair 53*a* (registration nip) (step S320, NO) and moves to step S330 once the leading end of sheet S enters into the registration nip (step S320, YES).

In step S330, control section 100 starts the above-described first registration displacement control (first control) on the basis of a position of the side edge of sheet S detected by line sensor 54. Through the first control, positional variations of the side edge of sheet S on the leading end side can be decreased, thereby ensuring accuracy in the subsequent second control.

Control section 100 continues the first control until sheet S enters into the secondary transfer nip (step S340, NO), and turns off line sensor 54 and moves to step S360 once the sheet S enters into the secondary transfer nip (step S340, YES).

In step S360, control section 100 starts the second control, i.e., second registration displacement control. Control section 100 starts displacement of registration roller pair 53*a*, i.e., movement in the width direction, according to the set value in step S310. In this step, control section 100 performs control such that registration roller pair 53*a* is moved in the same direction as the moving direction in the first control. Through such control, registration roller pair 53*a* is displaced, relative to sheet S that has entered into the secondary transfer nip, at a timing based on the preset value in the same direction as in the first control, and thus sheet S is displaced together with such displacement in the width direction.

At the start of the second control, the leading end side of sheet S (long paper) is pinched by the secondary transfer nip and conveyed while a toner image is formed, whereas the rear end side of the long paper is conveyed while being pressed by sheet feed roller 500 inside a sheet feed tray unit of an optional apparatus dedicated for long paper (see FIG. 4A).

Subsequently, control section 100 turns on line sensor 54 again to start detection of a side edge position of sheet S (step S380), and determines whether the side edge of sheet S has reached a target position (see the dotted lines of FIGS. 4A and 4B) (step S400). Control section 100 continues such detection of positions until the side edge of sheet S is determined to have reached the target position (NO in step S400 and step S380), and moves to step S420 once the side edge of sheet S is determined to have reached the target position (see FIG. 4B) (step S400, YES).

In step S420, control section 100 controls registration roller pair 53*a* so as to terminate the displacement. Through such termination control, the side edge of sheet S can accurately be aligned with a target position at the above-mentioned displacement point, and consequently shifting of the side edge of sheet S from a reference position (the dotted line of FIG. 4B) at the secondary transfer nip, which is on the further upstream side, can be prevented effectively.

Control section 100 then determines whether a subsequent displacement point exists (step S440), returns to step S360 if a subsequent displacement point exists (step S440, YES), and repeats the procedure from step S360 to step S440 described above.

When a plurality of displacement points are provided for sheet S as described above, control for starting and terminating displacement of registration roller pair 53*a* is performed a plurality of times in the second control.

As in the foregoing, when displacement is set to be performed after the leading end of sheet S has entered into a fixing nip or after the rear end of sheet S has passed out of looping rollers 53*b*, control section 100 controls, in step S360, registration roller pair 53*a* so as to start the displacement at the above-mentioned timing.

Meanwhile, control section 100 moves to step S460 if a subsequent displacement point does not exist (step S440, NO).

In step S460, control section 100 determines whether a print job is completed. As a result of the determination, control section 100 returns to step S300 if a print job is yet to be completed (step S460, NO), and performs printing processes, such as displacement control of registration roller pair 53*a* and image formation, for the following sheet S. Meanwhile, control section 100 terminates the above series of processes if a print job is completed (step S460, YES).

As described in detail above, according to the embodiment, sub-scanning obliqueness of sheet S due to misalignment and/or a diameter difference of each roller in the width direction can be corrected, and thus the occurrence of shifting of images and the like due to sub-scanning obliqueness can be prevented. According to the embodiment in which displacement termination of registration roller pair 53*a* is controlled on the basis of detected results of the side edge of sheet S by line sensor 54, sub-scanning obliqueness of sheets can be corrected more accurately than the conventional registration displacement control.

Further, according to the embodiment, a stop position of registration roller pair 53*a*, i.e., an offset value of the side edge of sheet S from a reference position, can be adjusted for every displacement point, and thus the occurrence of image defects on sheets S can be prevented effectively, compared with the conventional control.

In the above example, a case in which displacement of registration roller pair 53*a* is controlled in the second control by using preset values that specify timings of starting displacement operations is described. Alternatively, preset values may also specify timings of starting displacement operations in the first control. In this case, control section 100 controls displacement of registration roller pair 53*a* in the first control and the second control on the basis of timings specified by the preset values.

In the above-described embodiment, an example of an image forming apparatus including a transfer section that transfers images to be printed to sheets S by using intermediate transfer belt 421 (secondary transfer) is described. Alternatively, the embodiment can be applied similarly to an image forming apparatus (black-and-white printer, for example) of a transfer mode in which images to be printed are transferred to sheets S (primary transfer).

In the above embodiment, a case in which a sheet conveying member that is provided on the upstream side of the secondary transfer nip and that is displacement-controlled by control section 100 is registration roller pair 53*a* is described. As another example, rollers other than registration roller pair 53*a* and/or a sheet conveyance guide, for example, may be additionally or alternatively applicable to such a sheet conveying member.

In the above embodiment, a case in which cut sheets are used as sheets S is described. Alternatively, the embodiment is applicable to rolled paper in a similar manner.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus comprising:

a transferer that transfers an image to a sheet;

a sheet conveyor that is provided on an upstream side of the transferer in a conveying direction of the sheet and that conveys the sheet; and a hardware processor that controls displacement of the sheet conveyor such that the sheet is displaced in a width direction of the sheet, wherein:

the hardware processor causes a detector that detects an edge of the sheet in the width direction to detect the edge of the sheet only after the displacement of the sheet conveyor has been started and during movement of the sheet conveyor in the width direction of the sheet, and causes the displacement to be terminated on the basis of the detected result, after a leading end of the sheet has entered the transferer, such that the edge of the sheet reaches a target position, wherein the detecting by the detector is a first detecting of the edge of the sheet in the width direction by the hardware processor.

2. The image forming apparatus according to claim 1, wherein the hardware processor causes the displacement to be terminated once the edge of the sheet is aligned with the target position.

3. The image forming apparatus according to claim 1, wherein a conveyance roller on an upstream side or a downstream side of the sheet conveyor in the conveying direction is pressed against the sheet during the displacement.

4. The image forming apparatus according to claim 1, wherein the hardware processor performs control to execute the displacement incrementally on the basis of the detected result, and the hardware processor causes the detector to detect the edge of the sheet during incremental movement of the sheet conveyor in the width direction of the sheet.

5. The image forming apparatus according to claim 1, wherein the detector is arranged on a downstream side of the sheet conveyor and on an upstream side of the transferer in the conveying direction.

6. The image forming apparatus according to claim 1, wherein a size of the sheet in the conveying direction is a predetermined length or longer.

7. The image forming apparatus according to claim 1, wherein the hardware processor performs, when a load variation in the sheet arises:

(a) the starting of the displacement; and (b) on the basis of the detected result, the terminating of the displacement.

8. The image forming apparatus according to claim 7, wherein the hardware processor performs, when a torque of a driving source for conveying the sheet varies:

(a) the starting of the displacement; and (b) on the basis of the detected result, the terminating of the displacement.

9. The image forming apparatus according to claim 7, wherein the hardware processor performs the starting of the displacement and the terminating, when the leading end of the sheet enters a fixer, and/or when a rear end of the sheet passes out of a looping roller arranged on an upstream side of the sheet conveyor in the conveying direction.

10. An image forming apparatus comprising:

a transferer that transfers an image to a sheet;

a sheet conveyor that is provided on an upstream side of the transferer in a conveying direction of the sheet and that conveys the sheet; and a hardware processor that controls displacement of the sheet conveyor such that the sheet is displaced in a width direction of the sheet, wherein:

the hardware processor causes a detector that detects an edge of the sheet in the width direction to detect the edge of the sheet after displacement of the sheet conveyor has been started, and causes the displacement to be terminated on the basis of the detected result such that the edge of the sheet reaches a target position, wherein the hardware processor performs control to execute the displacement incrementally on the basis of the detected result, and wherein the hardware processor changes, corresponding to image forming conditions, an interval between timings of increments of the displacement.

11. The image forming apparatus according to claim 10, wherein the hardware processor changes the interval corresponding to a surrounding temperature and humidity environment of the image forming apparatus.

12. The image forming apparatus according to claim 10, wherein the hardware processor changes the interval corresponding to a type of the sheet.

13. The image forming apparatus according to claim 10, wherein the hardware processor changes the interval corresponding to a position of the sheet in the conveying direction.

14. The image forming apparatus according to claim 13, wherein the hardware processor sets the interval on a rear end side of the sheet in the conveying direction to be shorter than the interval on a leading end side of the sheet.

15. The image forming apparatus according to claim 1, wherein the hardware processor controls the displacement of the sheet conveyor by using a preset value that specifies a timing of starting the displacement.

16. The image forming apparatus according to claim 1, wherein the hardware processor performs:

first control that causes, before a leading end of the sheet in the conveying direction enters the transferer, the sheet conveyor to be displaced by an amount of displacement based on the detected result by the detector that detects an edge position of the sheet in the width direction; and second control that causes, after the leading end of the sheet has entered the transferer, a displacement operation of the sheet conveyor to be terminated so that the edge of the sheet reaches a target position, on the basis of the edge position detected by the detector after the displacement operation has been started.

17. The image forming apparatus according to claim 1, wherein the hardware processor causes the detector to detect the edge of the sheet in the width direction at least at a predicted timing of arrival of the edge of the sheet at the target position.

18. A conveyance control method for an image forming apparatus including a transferer that transfers an image to a sheet and a sheet conveyor that is provided on an upstream side of the transferer in a conveying direction of the sheet and that conveys the sheet, the method comprising:

starting displacement of the sheet conveyor such that the sheet is displaced in a width direction of the sheet;

detecting an edge of the sheet in the width direction only after the displacement has been started and during movement of the sheet conveyor in the width direction of the sheet; and terminating, on the basis of the detected result after a leading end of the sheet has entered the transferer, the displacement of the sheet conveyor such that the edge of the sheet reaches a target position, wherein the detecting is a first detecting of the edge of the sheet in the width direction.

19. The conveyance control method according to claim 18, comprising:

performing first control that causes, before a leading end of the sheet in the conveying direction enters the transferer, the sheet conveyor to be displaced by an amount of displacement based on a detected result by a detector that detects an edge position of the sheet in the width direction; and performing second control that causes the terminating.

* * * * *